US005975981A

United States Patent [19]

Crouthamel

[11] Patent Number: 5,975,981

[45] Date of Patent: Nov. 2, 1999

[54] METHOD FOR MAKING RAFFIA DOLLS

[76] Inventor: Dennis M. Crouthamel, 321 N. Ambler St., Quakertown, Pa. 18951

[21] Appl. No.: 09/111,830

[22] Filed: Jul. 8, 1998

Related U.S. Application Data

[63] Continuation-in-part of application No. 29/078,631, Oct. 30, 1997, Pat. No. Des. 398,340.

[51] Int. Cl.[6] ..... A63H 3/00

[52] U.S. Cl. ..... 446/373; 446/385

[58] Field of Search ..... 446/370, 372, 446/373, 374, 385

[56] References Cited

U.S. PATENT DOCUMENTS

| | | | |
|---|---|---|---|
| 1,612,805 | 1/1927 | Francke | 446/385 |
| 1,822,437 | 9/1931 | Fleming | 446/373 |
| 2,215,977 | 9/1940 | Salomon | 446/374 |
| 2,535,818 | 12/1950 | Smalley | 446/370 |
| 4,854,912 | 8/1989 | Koh | 446/373 |
| 4,939,005 | 7/1990 | Whitson | 428/13 |
| 4,959,036 | 9/1990 | Koh | 446/385 |

FOREIGN PATENT DOCUMENTS

| | | | |
|---|---|---|---|
| 516344 | 1/1953 | Belgium | 446/373 |
| 862867 | 1/1953 | Germany | 446/385 |
| 122100 | 1/1919 | United Kingdom | 446/374 |

*Primary Examiner*—John A. Ricci
*Attorney, Agent, or Firm*—Joseph W. Molasky & Associates

[57] ABSTRACT

A method of making a fibrous doll, in particular a raffia doll, is disclosed that uses an internal support structure so that each doll as constructed will be essentially identical in form. The internal support structure comprises a lower conical form, a central shaft and a spherical member. The spherical member defines the head portion of the doll and the central shaft extends between the spherical member and the lower conical form to define the height of the doll.

18 Claims, 6 Drawing Sheets

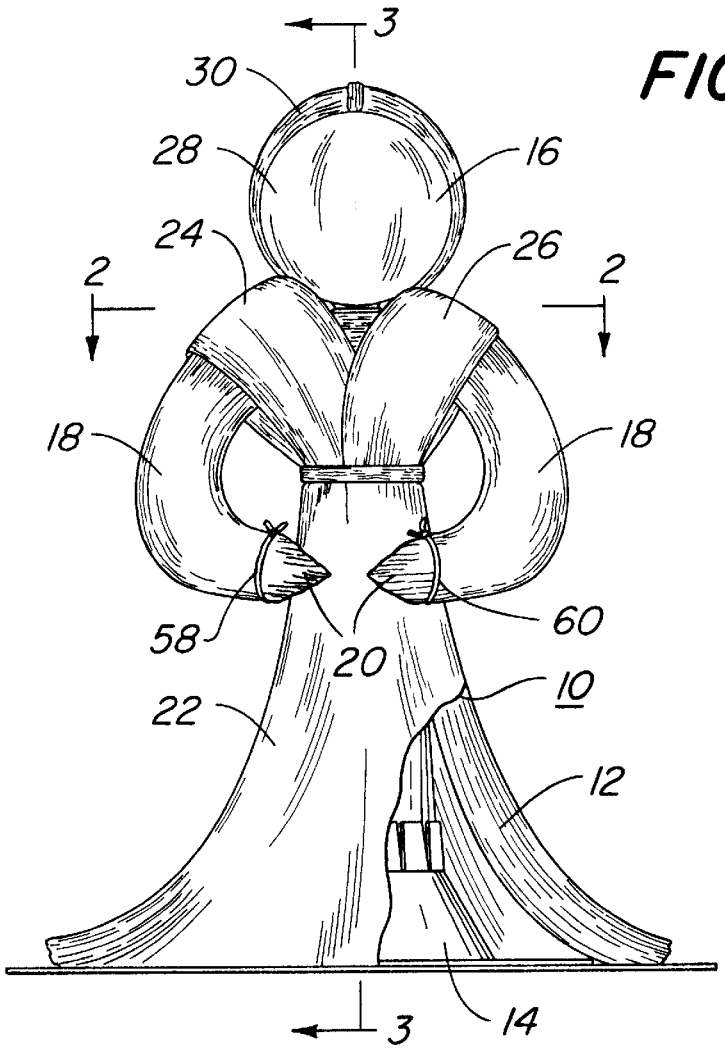
FIG. 1
FIG. 2
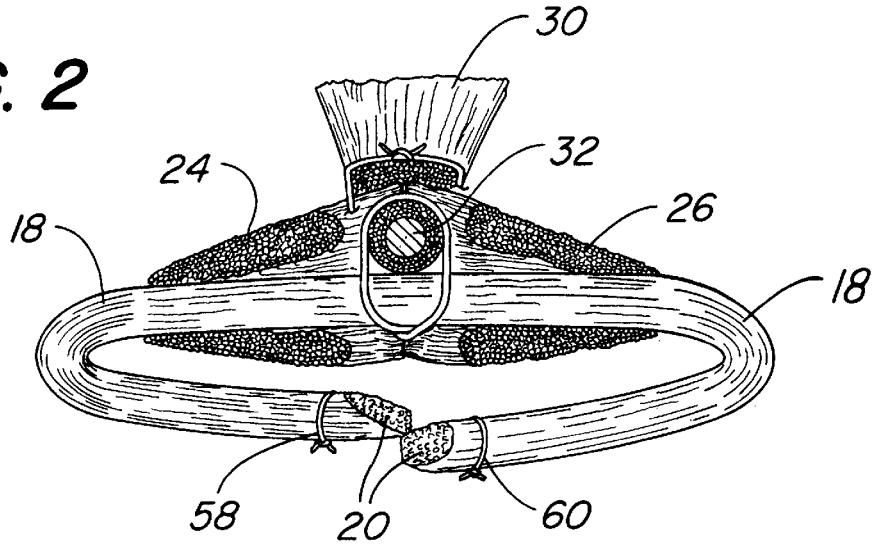

FIG. 8
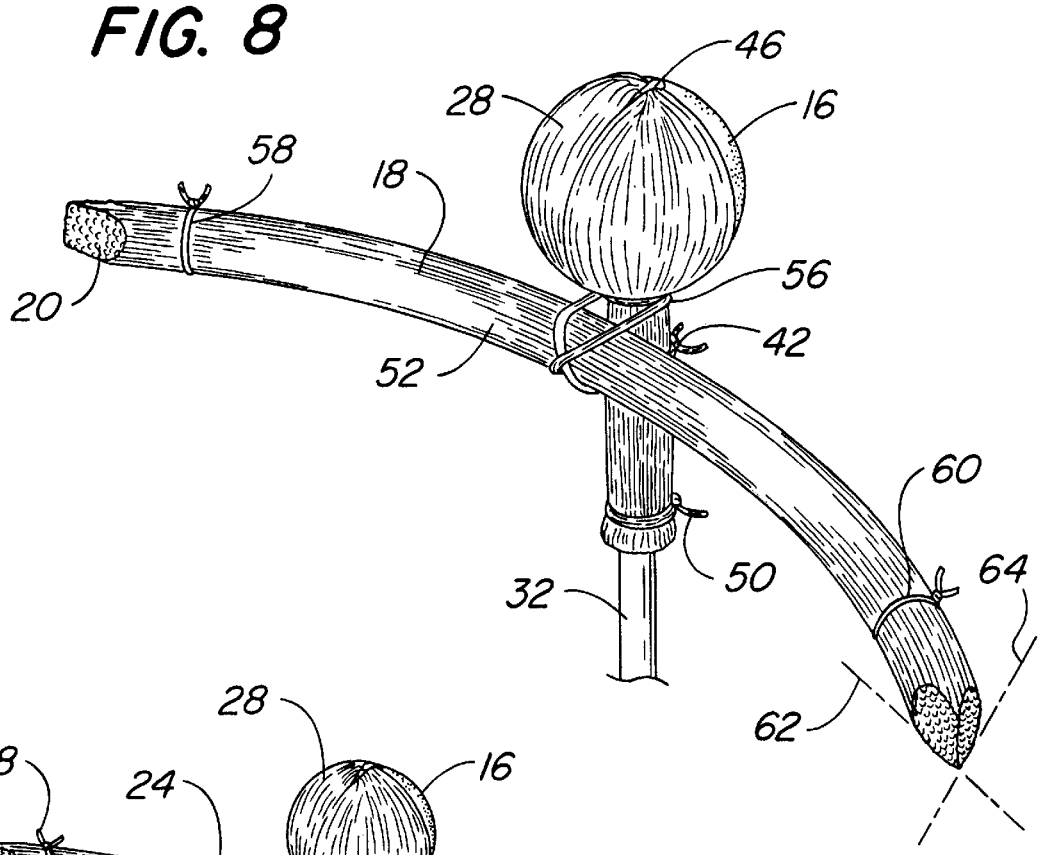
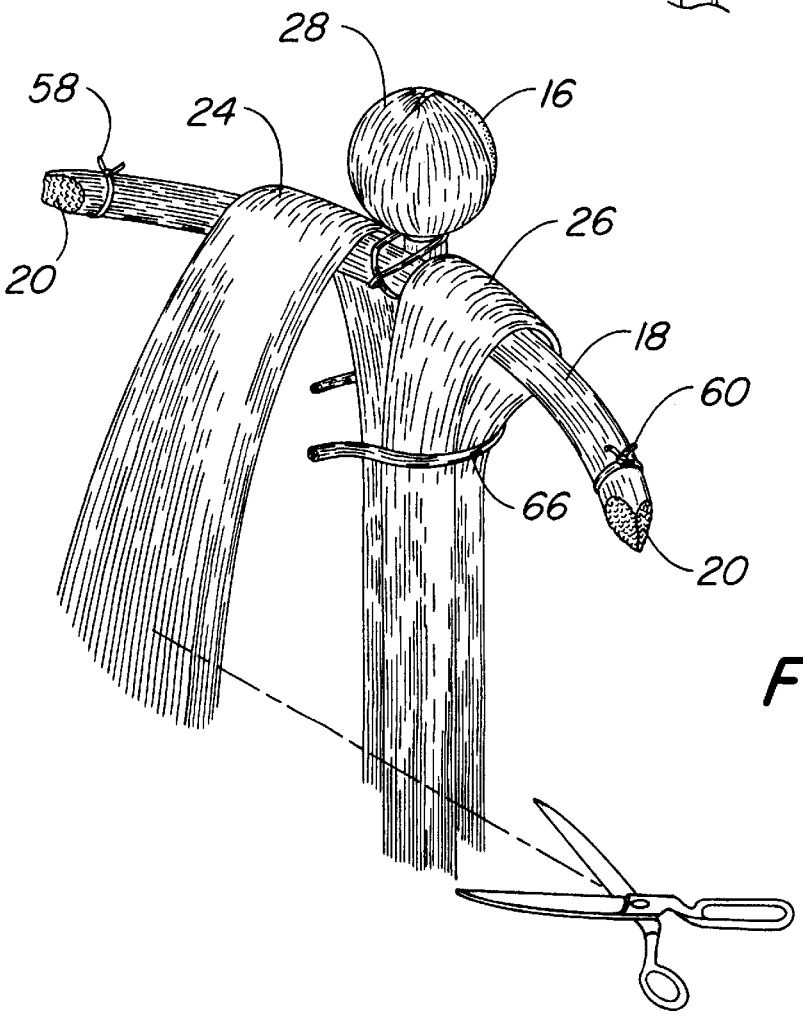
FIG. 9

FIG. 12
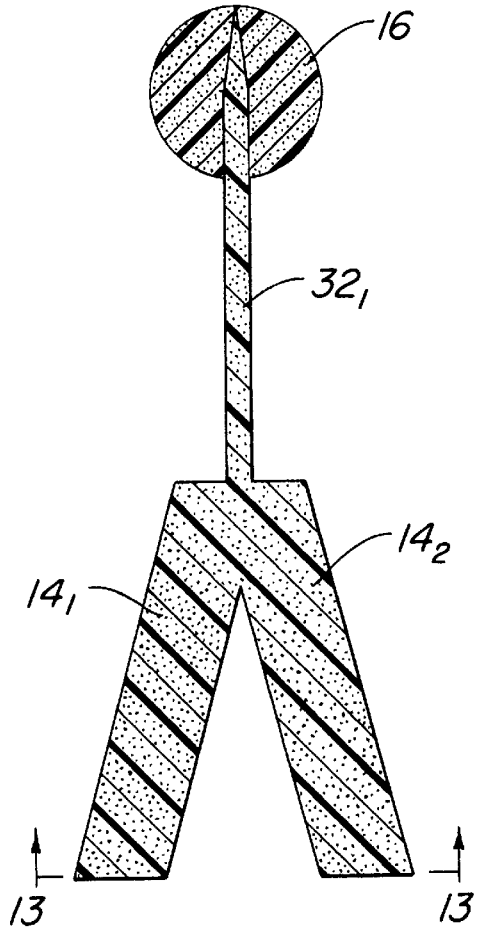
FIG. 13
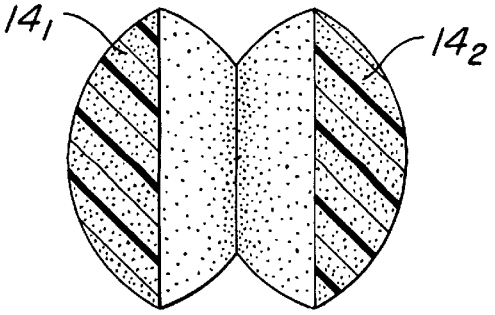
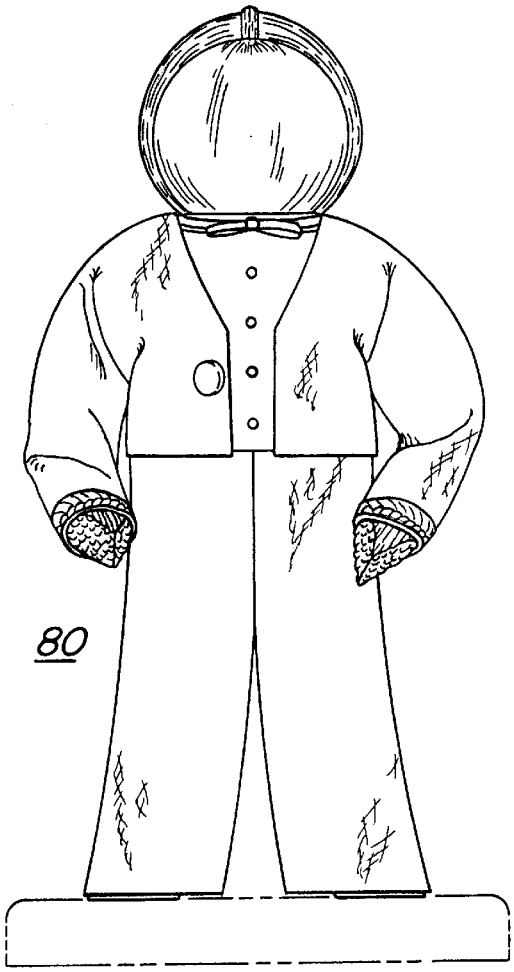
FIG. 14

METHOD FOR MAKING RAFFIA DOLLS

This application is a continuation-in-part of Design patent application Ser. No. 29/078,631, filed Oct. 30, 1997, now U.S. Pat. No. Des. 398,340.

SUMMARY OF THE INVENTION

The present invention relates to a method of making raffia dolls and, more particularly, to a method that allows for individual dolls to be quickly produced with essentially identical features.

In accordance with the present invention, a raffia doll is made by using an internal support structure consisting of a conical form, central shaft and spherical top portion. The raffia (or other fibrous material) is wrapped around the support structure in a set of predetermined steps so as to form a doll structure that may be easily replicated time and again.

It is an aspect of the present invention that the raffia may be re-wetted after completing a number of the fabrication steps to alter the particular configuration of the doll; for example, the flair of the skirt or the position of the hands.

Other and further aspects of the present invention will become apparent during the course of the following discussion and by reference to the accompanying drawings.

BRIEF DESCRIPTION OF THE DRAWINGS

Referring now to the drawings, where like numerals represent like parts in several views:

FIG. 1 is a front view of a raffia doll formed in accordance with the present invention;

FIG. 2 is a cut-away view in perspective of a raffia doll, taken along line 2—2 of FIG. 1;

FIGS. 4–11 illustrate the separate steps involved in constructing the raffia doll illustrated in FIG. 1;

FIGS. 12–14 illustrate an alternative raffia doll that may be constructed using a modified conical form.

DETAILED DESCRIPTION OF THE PREFERRED EMBODIMENTS

Figure 3:
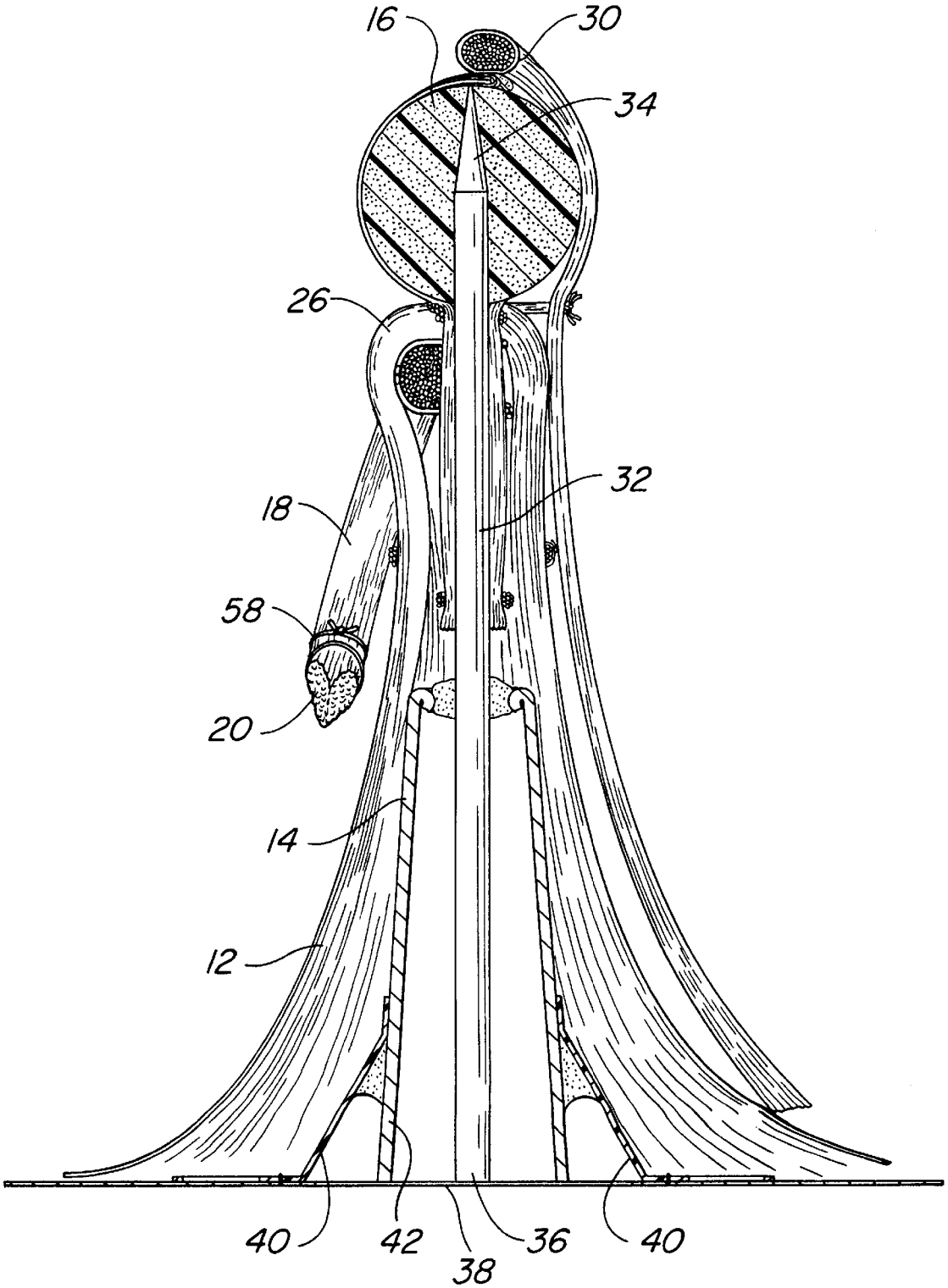
FIG. 3 is a cut-away side view of a raffia doll, taken along line 3—3 of FIG. 1 and illustrating in particular the internal support structure of the doll.

An exemplary raffia doll 10 that may be formed using the method of the present invention is illustrated in FIG. 1. A portion of a raffia skirt 12 is cut away in this view to show a conical form 14 that comprises a portion of the internal support structure. A spherical member 16 of the internal support structure is also evident in this view, where member 16 may comprise a stiff foam material. In general, raffia doll 10 comprises raffia arms 18 with tapered hands 20, where the arms may be disposed in any desired position, as discussed further below. Doll 10 further comprises a raffia body 22 that comprises two separate sets of raffia fibers 24 and 26 that are disposed over the shoulder area then combined to form flared skirt 12. A head 28 may be covered with a different fiber material, as described below, then covered with a raffia hair piece 30.

FIG. 2 is a cut-away view of doll 10, taken along line 2—2 of FIG. 1, the shoulder area of doll 10. Evident in this view is the cross-section of a central shaft 32 which forms part of the internal support structure. Front and back portions of raffia fiber bundles 24 and 26 are also shown in this view. A cut-away side view of doll 10 is shown in FIG. 3, where this view clearly illustrates each component of the internal support structure. In particular, the internal support structure comprises conical form 14, central shaft 32 and spherical member 16. As shown, central shaft 32 includes a first, tapered end 34 which extends through the entire diameter of spherical member 16. The opposing end 36 of central shaft 32 is disposed through the center of conical form 14 so as to coextensive with the bottom surface 38 of conical form 14. Therefore, in accordance with the present invention, the length of central shaft determines the final height of raffia doll 10 and by repeatedly using shafts of identical length (in association with spherical members of like diameter), numerous dolls may be manufactured that will be essentially identical in size and form. As will be discussed in detail in association with the exemplary method steps, conical form 14 may comprise separate piece parts, in particular, a flared component 40 and central cylinder component 42, with flared component 40 disposed around the bottom of cylinder component 42 to ensure a sufficient flair in raffia skirt 12 of doll 10.

Figure 4:
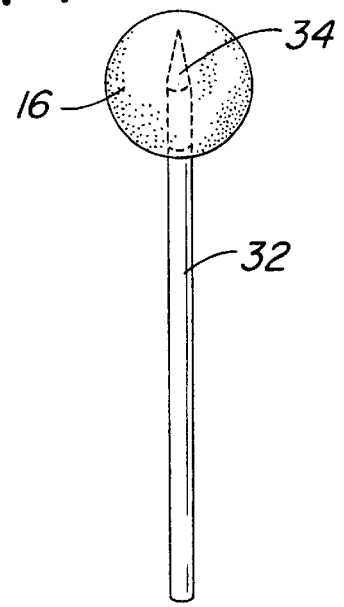
Figure 5:
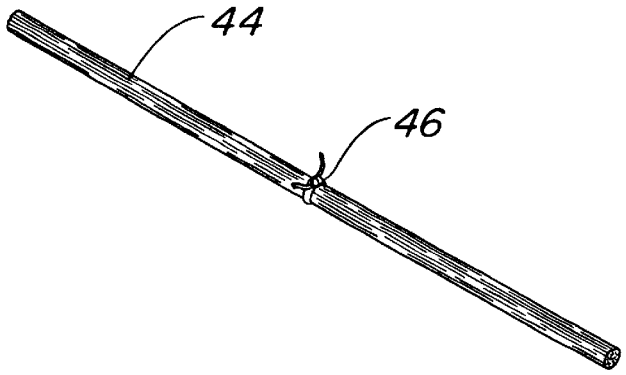
Figure 7:
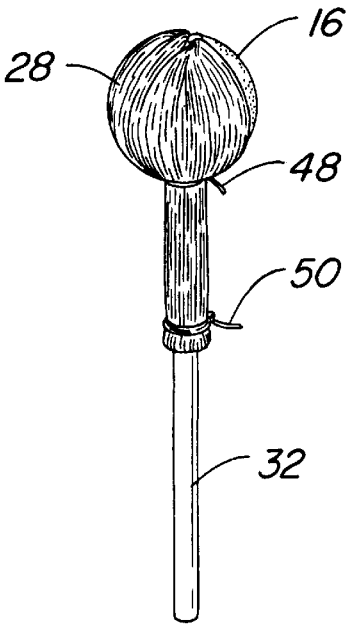
Figure 6:
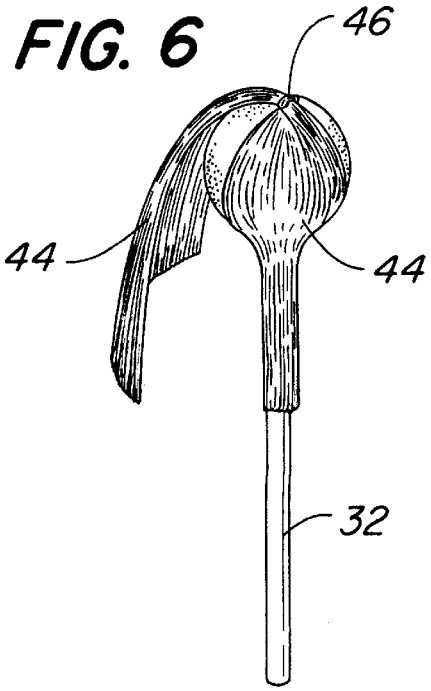

An exemplary process for creating doll 10 as shown in FIG. 1 will now be explained in detail. Referring to FIG. 4, a first step comprises inserting central shaft 32 of the internal support structure through spherical member 16. As described above, this combination determines the final height of the completed doll. In a preferred embodiment, tapered end 34 of central shaft 32 is inserted through essentially the entire diameter of spherical member 16. The head 28 of doll 10 is next formed, as illustrated in FIGS. 5–7, by using a bundle 44 of fibrous material different from the raffia used for the rest of the doll as, for example, sisal, horse hair, or any type of artificial hair, although, in general, any fine fibrous material is appropriate. Bundle 44 is tied at its midpoint 46 using a natural fibrous material. Midpoint 46 is then located at the top of spherical member 16 and bundle 44 is spread out to cover approximately two-thirds of the surface of spherical member 16. The remaining third of spherical member 16 will ultimately be covered by the doll's hair and need not be covered with the face material. Once fiber bundle 44 is sufficiently spread out over spherical member 16, a pair of ties 48, 50 are used to hold bundle 44 in place with respect to central shaft 32, as shown in FIG. 7.

The next step in the exemplary process, as illustrated in FIG. 8, is the formation of arms 18 with hands 20. In particular, a suitably sized bundle of raffia material 52 is used, where a midpoint 54 of material 52 is attached to shaft 32 directly under spherical member 16 in the region covered by head 28. A natural tie 56 is used to secure raffia material 52 at this location. Hands 20 are formed by first defining hand areas using ties 58, 60 located a predetermined distance from each termination, where a thin gauge wire may be used to form each hand tie 58, 60. The beveled appearance of hands 20 is created by cutting each end of raffia material 52 along opposing directions, as illustrated by dotted lines 62, 64 in FIG. 8.

The body portion of doll 10 is next created by using a pair of raffia fiber bundles 24, 26, as defined in FIG. 1, where each bundle is draped over a shoulder portion of doll 10, as shown in FIG. 9. That is, first bundle 24 may be draped over the right shoulder area so as to cover a first portion of arm 18 and second bundle 26 may be draped over the left shoulder area so as to cover a second, opposing portion of arm 18. Bundles 24 and 26 are then combined to cover central shaft 32 and secured in the waist area with a tie 66. The bottom of bundles 24, 26 (which will form the bottom of flared skirt 12) may be trimmed once tie 66 is in place to ensure that all of the fiber ends are even.

Figures 10, 11:
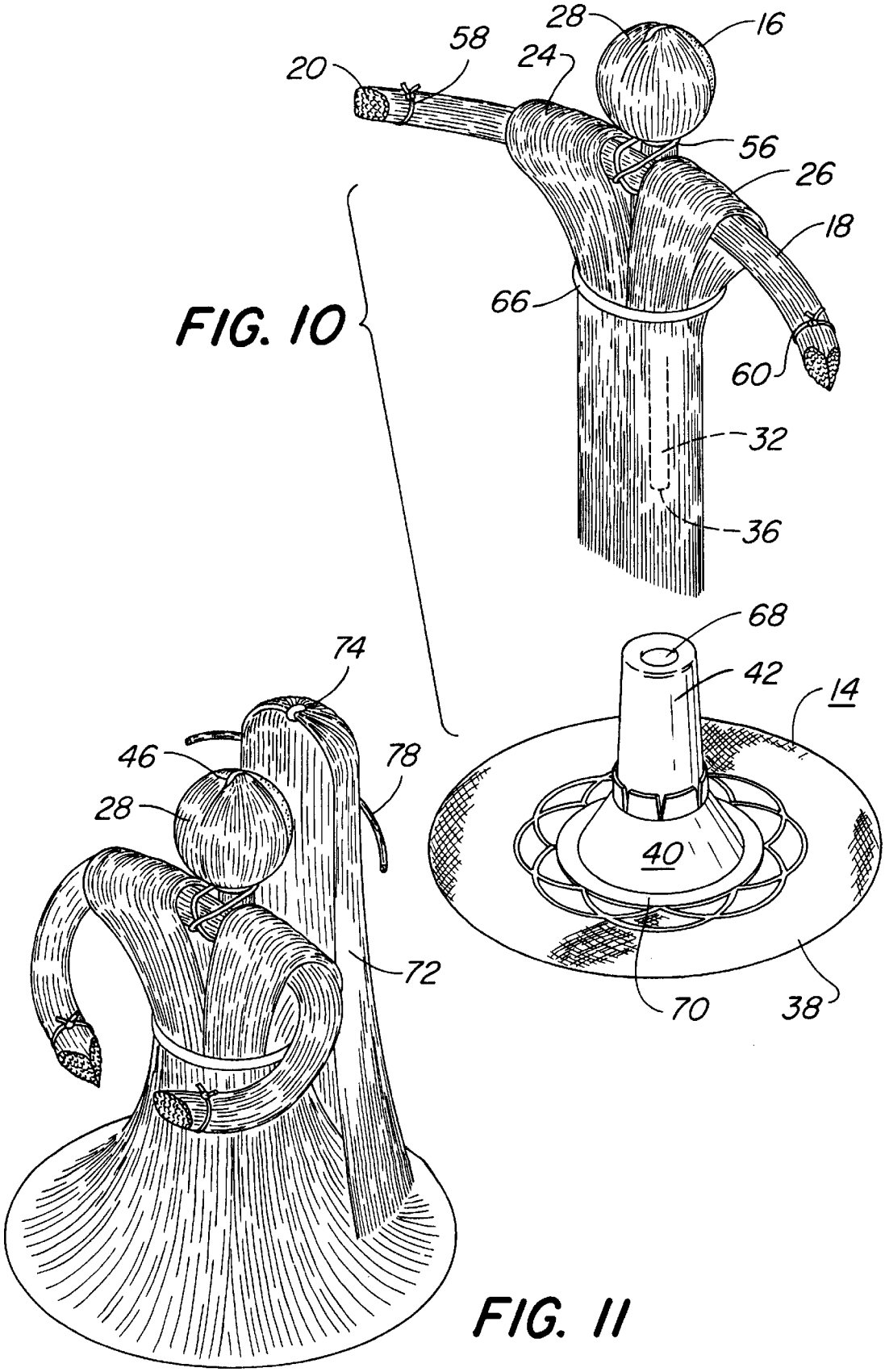

Doll 10, in this form, may then be inserted into the remaining portion of the internal support structure. Referring to FIG. 10, central shaft 32 (illustrated in phantom) will be inserted through a central aperture 68 in conical form 14 until end 36 of shaft 32 rests against bottom surface 38 of conical form 14. In the particular embodiment illustrated in FIG. 10, conical form 14 includes flair portion 40 disposed to surround central cylinder 42, with an additional lower support member 70 attached to the underside of flair portion 40. Member 70, essentially a circular disc, is formed to include a diameter somewhat larger than the diameter of flair portion 40 so as to provide for extra mechanical support for the doll.

Once doll 10 has been secured to conical form 14, hair 30 (FIG. 1) is added by using a raffia bundle 72, tied at its midpoint 74. Midpoint 74 is located over midpoint 46 on head 28. Bundle 72 is then spread and properly shaped to form hair 30. Once the hair has been properly shaped a fiber tie 78 is used to secure hair 30 around shaft 32 under spherical member 16, as shown in FIG. 11. At any time during the final steps as shown in FIGS. 10 and 11, the raffia material may be re-wetted to properly flair skirt portion 12, arms 18 and hands 20, and hair 30. Additionally, lace material (not shown) may be added around the bottom periphery of skirt 12. Various other decorative features are possible (in terms of dressing the doll's body and face, for example), where all of these still utilize the fabrication steps of the present invention as described above.

An alternative internal support structure for a raffia doll is illustrated in FIG. 12. In this embodiment, shaft $\mathbf{32}_1$ is shortened to terminate at the waist area of a conical form 14, which in this embodiment may be formed of a stiff foam material (and, in particular, may be formed as an integral part of shaft 32) and split as shown to form two separate portions $\mathbf{14}_1$ and $\mathbf{14}_2$. FIG. 13 illustrates the bottom of form 14, illustrating the bottom surfaces of portions $\mathbf{14}_1$ and $\mathbf{14}_2$. In this embodiment, a raffia doll may be formed to include separate "legs", since central shaft 32 does not extend fully to the bottom surface of the doll. For this embodiment, therefore, the height of the doll is formed by the combination of each part of the internal support structure. The method steps illustrated in FIGS. 4–11 are used to form a raffia doll such as the alternative doll 80 of FIG. 14, with the only difference being the formation of legs instead of a flared skirt.

It is to be understood that the doll of the present invention may be formed of other appropriate fibrous materials, for both the face as well as the doll itself. Additionally, as mentioned above, various types of materials may be used to form the internal support structure, and all are considered to fall within the spirit and scope of the present invention as defined by the claims found hereinbelow.

What is claimed is:

1. A method for making a doll comprising the steps of:

a) forming an internal support structure comprising a central shaft of a predetermined length with a spherical member inserted through a first end thereof;

b) forming a bundle of fine fibrous material and disposing said bundle over said spherical member so as to cover a majority of the surface thereof;

c) securing said bundle to said central shaft in the area where said shaft and spherical member are joined;

d) forming a bundle of fibrous material having a predetermined diameter and determining a midpoint of said bundle;

e) attaching the midpoint of said bundle of step d) to said central shaft so that said bundle is disposed contiguous with the covered portion of said spherical member;

f) forming a pair of fibrous bundles and disposing a separate bundle of said pair of fibrous bundles over each side of said attached fibrous bundle from step e), positioning each separate bundle in relative proximity to said midpoint;

g) spreading said pair of fibrous bundles to form a doll body and securing a waist area thereof; and h) attaching said doll as formed through step g) to a conical form, said conical form defined as a portion of the internal support structure, wherein said central shaft is attached to said conical form to provide for the attachment.

2. A method for making a doll as defined in claim 1 wherein in performing step b), the following steps are performed:

1) defining a midpoint of the fine fibrous material;

2) tying said bundle at the midpoint; and 3) attaching said midpoint to the top of the spherical member.

3. A method for making a doll as defined in claim 1 wherein in performing step b), sisal fiber is used.

4. A method for making a doll as defined in claim 1 wherein in performing step b), horse hair is used.

5. A method for making a doll as defined in claim 1 wherein in performing step b), artificial hair is used.

6. A method for making a doll as defined in claim 1 wherein in performing step d), the following steps are performed:

1) securing a tie member near each end termination of the bundle;

2) beveling each end termination to form hand areas on said bundle.

7. A method for making a doll as defined in claim 6 wherein in performing step d), a relatively thin gauge wire is used as the tie member.

8. A method for making a doll as defined in claim 6 wherein in performing step d), raffia fibrous material is used to form the bundle.

9. A method for making a doll as defined in claim 1 wherein in performing step f), raffia fibrous material is used to form each bundle of the pair of bundles.

10. A method for making a doll as defined in claim 1 wherein in performing step h), a conical form including a lower flared section is used and in performing step g), the fibrous material is spread over said flared section to form a skirt for the doll.

11. A method for making a doll as defined in claim 1 wherein in performing step h), a conical form including a split bottom portion including two separate sections is used and in performing step g), the fibrous material is spread to form a separate doll leg to cover each separate section.

12. A fibrous material doll comprising:

an internal structure including a spherical member;

a central shaft of a predetermined length, a first end of said central shaft inserted through the diameter of said spherical member; and a conical form including a flared lower section and a smaller upper section, the remaining end of said central shaft disposed through the center of said conical form so as to be co-extensive with said flared lower section;

a plurality of fibrous bundles disposed to cover said internal structure and form a fibrous material doll.

13. A fibrous material doll as defined in claim 12 wherein an additional set of fine fibrous material is included and is disposed to cover the spherical member to form a face.

14. A fibrous material doll as defined in claim 13 wherein sisal fiber is used.

15. A fibrous material doll as defined in claim 12 wherein the plurality of fibrous bundles comprise a plurality of raffia bundles.

16. A fibrous material doll as defined in claim 15 wherein a first raffia bundle is defined as having a midpoint, the midpoint attached to the intersection of said spherical member and said central shaft so as to form arms for the fibrous material doll, a second raffia bundle is disposed to cover a first portion of said first bundle near the intersections of said spherical member and said central shaft and a third raffia bundle is disposed to cover a second portion of said first bundle near the opposing intersection of said spherical member and said central shaft, the second and third bundles forming clothing for said fibrous material doll.

17. A fibrous material doll as defined in claim 16 wherein the plurality of raffia bundles further comprise a fourth raffia bundle attached to the top surface of said spherical member at a central point thereof, said fourth raffia bundle defined as forming hair for the fibrous material doll.

18. A fibrous material doll as defined in claim 12 wherein the conical form comprises:

a cylindrical member; and a flared member, the flared member disposed to surround said cylindrical form and the central shaft disposed through a central opening in the cylindrical member so as to be co-extensive with said flared member.

* * * * *